United States Patent [19]

Muragaki

[11] Patent Number: 5,005,505

[45] Date of Patent: Apr. 9, 1991

[54] METHOD OF SUPPLYING THREAD FROM A REEL TO SEWING MACHINE AND HANGER USED THEREIN

[75] Inventor: Ryoichi Muragaki, Osaka, Japan

[73] Assignee: Muragaki Co., Ltd., Osaka, Japan

[21] Appl. No.: 413,562

[22] Filed: Sep. 27, 1989

[30] Foreign Application Priority Data

Oct. 3, 1988 [JP] Japan ..... 63-130378[U]

[51] Int. Cl.[5] ..... D05B 47/02; D05B 43/00; D05B 47/04

[52] U.S. Cl. ..... 112/302; 112/254; 112/273; 112/278

[58] Field of Search ..... 112/254, 255, 273, 278, 112/302

[56] References Cited

U.S. PATENT DOCUMENTS

| | | | |
|---|---|---|---|
| 2,497,359 | 2/1950 | Isabelle | 112/302 |
| 2,508,887 | 5/1950 | Orrigo | 112/254 |
| 2,528,171 | 10/1950 | Pehlivanian | 112/302 |
| 2,610,599 | 9/1952 | Picciano | 112/302 |
| 3,182,926 | 5/1965 | Imhof | 112/302 X |
| 3,192,885 | 7/1965 | Timm | 112/303 X |
| 4,023,512 | 5/1977 | Miyamoto | 112/254 X |

FOREIGN PATENT DOCUMENTS

| | | | |
|---|---|---|---|
| 0834496 | 2/1952 | Fed. Rep. of Germany | 112/302 |
| 0033447 | 1/1905 | Switzerland . | |
| 0784472 | 10/1957 | United Kingdom | 112/302 |

*Primary Examiner*—Werner H. Schroeder
*Assistant Examiner*—Ismael Izaguirre
*Attorney, Agent, or Firm*—Darby & Darby

[57] ABSTRACT

A method of supplying a thread to a sewing machine from a reel wherein the thread is supplied by carrying on a hanger a loop produced between the reel and the sewing machine by twisting the thread two to three times. The hanger used in supplying the thread comprises a case body, a cylindrical dial partly exposed on the surface of the case body, and a hook projecting from the case body to catch the thread. The hook is coupled through gearing to the dial and is rotatable in response to rotation of the dial.

12 Claims, 8 Drawing Sheets

METHOD OF SUPPLYING THREAD FROM A REEL TO SEWING MACHINE AND HANGER USED THEREIN

BACKGROUND OF THE INVENTION

This invention relates to a method for supplying a thread to a sewing machine and a hanger used therein.

Usually, in a sewing machine for industrial use, the thread is drawn out axially from a reel placed on a thread stand and fed to the sewing machine. If the thread is drawn out upwards, the reel need not be rotated. In industrial use, since the reel itself is large, in order to take out the thread by rotating the reel, a substantial force is required and it is almost impossible to accomplish this in the conventional sewing machine.

In order to draw out the thread upwardly, the direction from the reel to the sewing machine is changed by hooking the thread to a hanger such as a hook provided right above the installed reel.

For example, as shown in FIG. 7, the reel 10 is set on the thread stand 13 placed on a table 12 onto which the sewing machine 11 is installed. On a bottom plate 14 of the thread stand 13, a supporting rod 15 is erected to support the reel 10 by inserting the rod therethrough. Above the bottom plate 14, a horizontal arm 17, supported by an elongated rod 16, is provided and formed with hooks 18 on opposite ends thereof. A thread 19 from the reel 10, set on the supporting rod 15, is drawn out upwards from the reel 10 and supplied to the sewing machine 11 through the hook 18 of the horizontal arm 17.

However, a serious problem was encountered in the method of drawing out the thread axially from the reel to supply to the sewing machine. That is, when supplying the thread 19 from the reel 10 to the sewing machine 11, a twist loop 20 is not produced since a tension force is exerted on the thread during the operation of the sewing machine. However, if the sewing machine 11 is stopped when, for example, replacing the material being sewn, the thread 19 is loosened (indicated by the one-dot chain line in FIG. 7) and tends to produce the twist loop 20.

To "twist", as stated herein, is to fix one end of the thread and rotate the other end about the longitudinal thread axis, or to rotate both ends in opposite directions (refer to FIG. 8*a*). This twist happens in the same way when the thread is drawn out axially from the reel (refer to FIG. 8*b*). "Twist" also represents a twisted state of the thread.

To "loop-twist" is to produce a loop on the thread while twisting (refer to FIG. 8*c*). The loop produced by loop-twisting is called a twist-loop.

To "vertical-twist" is to rotate the thread at right angles to the lengthwise thread direction. Therefore, it is entirely different from the twisting of FIGS. 8*a, b*. The loop produced by the vertical-twist is called a vertical twist-loop (refer to FIG. 8*d*).

When a twist loop 20 is produced, it is sent to the sewing machine 11 through the prior art hook 18, so that there is a problem in that the hook is not caught by the adjuster of a thread tension adjusting device (not shown) of the sewing machine 11, or the loop causes a large resistance (refer to one-dot chain line in FIG. 7), consequently causing the sewing operation to stagnate seriously by breaking the thread, or causing an uneven seam due to unbalanced tension between the upper and lower thread; or breaking of needles, and so on.

Therefore, in the industry, there is a need for a method in which the twist 20 is not produced or, if produced, it is not brought to the sewing machine.

SUMMARY OF THE INVENTION

In view of the present situation as described above, as the result of my research, completed the method of the present invention and a hanger. A feature of the method is that, when a thread wound on a reel is drawn out axially therefrom to be supplied to a sewing machine, the hanger retains a twist-loop or vertical-twist-loop. The hanger includes a case body, a cylindrical dial within the case body having a peripheral surface exposed partly on a case body surface, and a hook formed on the tip end of a shaft projecting from the case body to catch the thread, said hook being coupled to the dial through gearing and rotatable axially, responsive to rotation of the dial. When the thread, wound on the reel is drawn out axially therefrom to be supplied to the sewing machine, a vertical-twist-loop is formed on the thread by vertical-twisting, and the vertical-twist-loop is hung on the hook.

DESCRIPTION OF THE PREFERRED EMBODIMENTS

Figure 1:
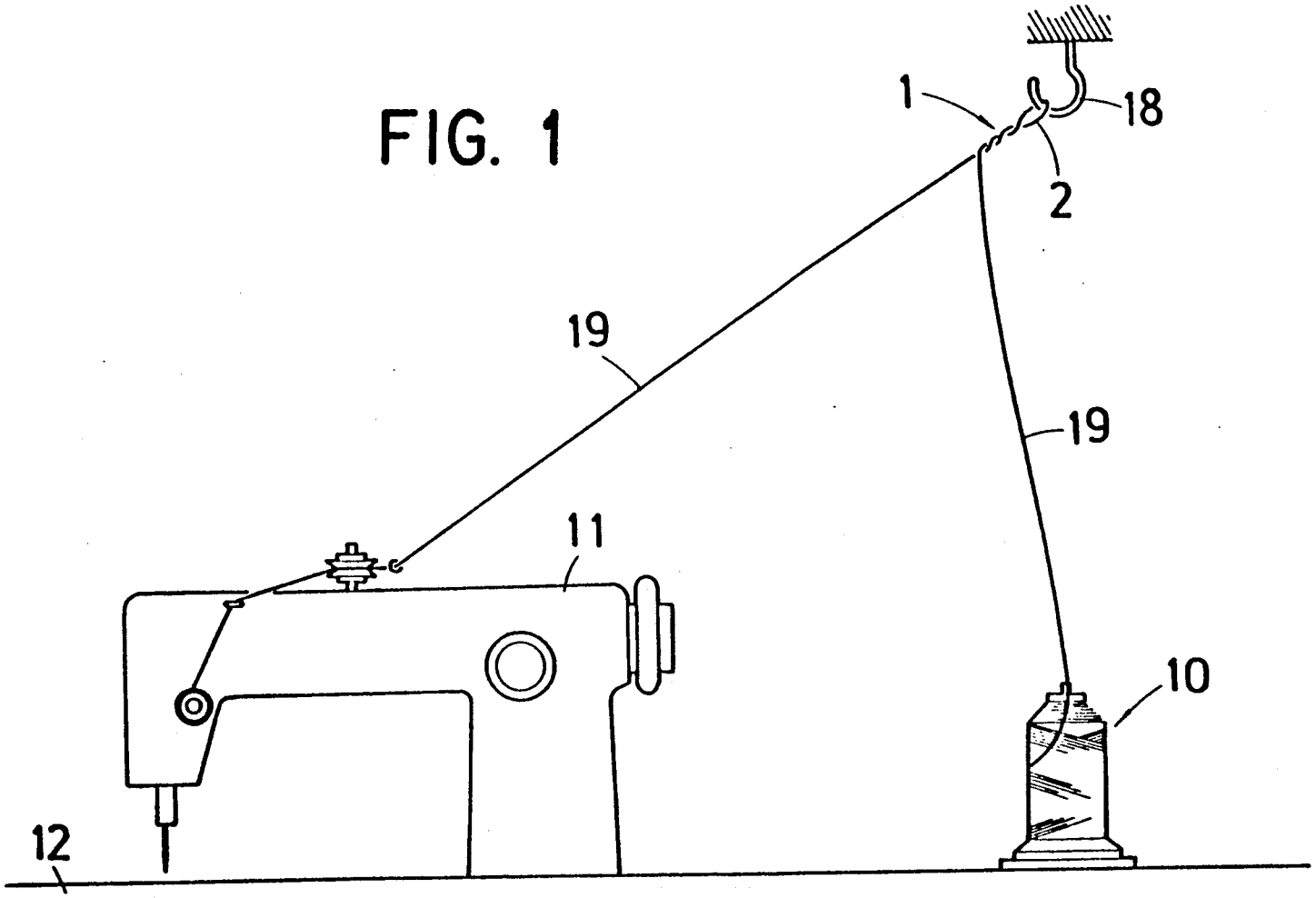
FIG. 1 is a front view showing an example wherein the method of the present invention is applied, FIG. 2 (*a*), (*b*) are front views respectively showing a condition wherein an existing twist-loop is automatically eliminated, FIG. 3 (*a*), (*b*) are front views respectively showing how a vertical-twist-loop is produced, FIG. 4 (*a*) is a front view showing an embodiment of a hanger of the present invention, and FIG. 4 (*b*) is an exploded perspective view of the hanger shown in FIG. 4 (*a*)

A thread used in the present invention is defined as the thread supplied to a sewing machine for sewing cloth and the like thereby, and may be any thread of silk, rayon, synthetic fiber, cotton, wool, hemp yarn and the like.

A reel is a fiber tube or a plastic tube on which a thread is wound. There are cylindrical cheese and conical cone shaped reels.

To draw out axially is to draw out the thread from a reel in the direction of the winding axis of the reel. The thread need not be drawn out precisely parallel to the axis, but may be substantially in that direction.

A hanger as used herein is designed to catch a thread and to change its direction. Though, in general, a hook-shaped hanger is used, it may take the form of a ring into which the thread is inserted and suspended.

When the thread is hung on the hanger, it is not simply suspended thereon but is held through a loop produced in the thread. The loop may be either a twist-loop or a vertical-twist-loop. Though the number of loop-twists or vertical-twists is not limited particularly, it is preferably 1 to 3 twists. The loop-twisting or vertical-twisting direction is preferably in the direction counter to the twisting direction of the thread that is drawn out from the reel.

The loop held by the hanger is maintained as it is during the sewing operation. When the sewing machine comes to a standstill and the thread tension is reduced so as to produce a twist-loop near the reel, this loop near the reel is eliminated by the loop suspended on the hanger when the sewing machine resumes operation. The reason is that, although not clearly known, the twist-loop produced on stopping operation is eliminated by friction of the lower entwined portion of the loop at the hanger.

The hanger of the present invention is the one used in the method described above.

A dial is a cylindrical element provided with grooves around its periphery, or it may be formed unevenly to be rotated easily by friction.

A shaft couples the dial with a hook and is an elongated cylinder. The hook may be constructed integrally with the shaft.

The hook serves to hang the thread and usually takes the form of a fishing hook.

Since the hanger is constructed in such a manner, the twist-loop aforementioned can be produced just by hanging the thread on the hook and rotating the dial.

The present invention will be described in greater detail with reference to the embodiments shown in the drawings as follows.

FIG. 1 is an embodiment using a method of the present invention, showing a state wherein a thread 19 is supplied to a sewing machine 11 from a reel 10. The arrangement is such that the thread 19 from the reel 10 is adapted to be supplied to the sewing machine 11 through a hook 18 provided above the reel 10, a vertical-twist-loop 2 being caught by the hook 18. By holding the vertical-twist-loop 2 by the hook 18 in such a manner, the thread 19 from the reel 10 is supplied while being rubbed against itself at an entwined portion 1 formed below the vertical-twist-loop 2.

Figure 2A:
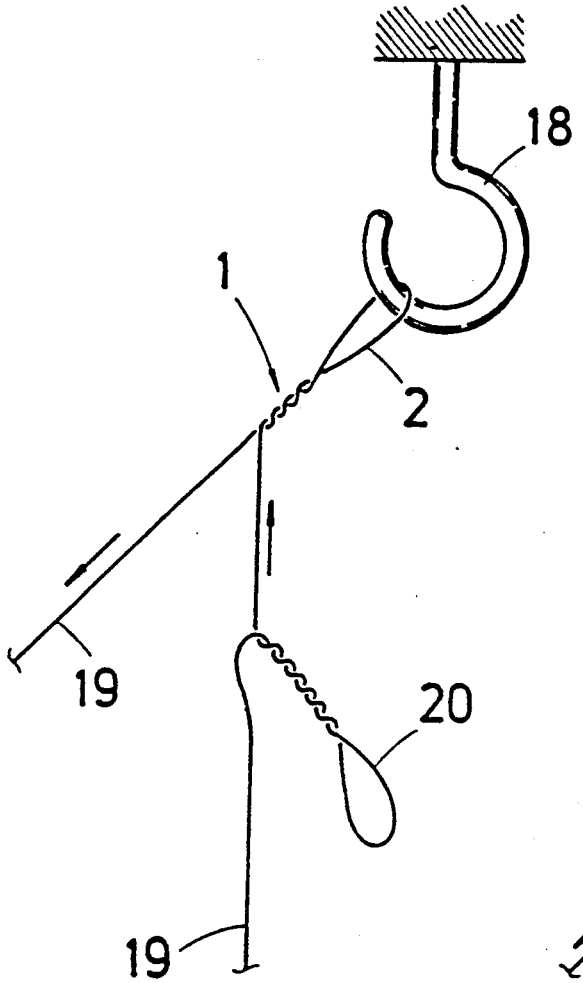
Figure 2B:
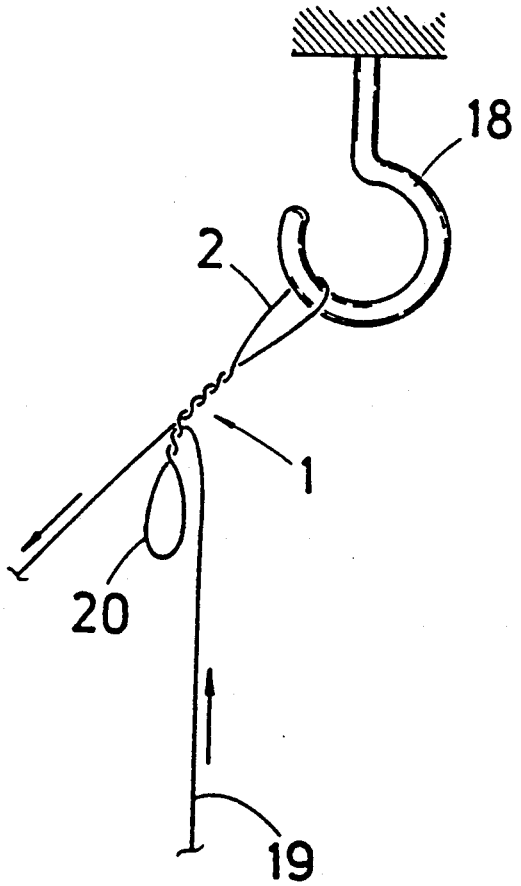

Thus, even when an unwanted twist-loop 20 is produced by twisting on the thread 19 immediately after being drawn out from the reel 10, the loop 20 is eliminated by passing through the entwined portion 1. It is considered that, as shown in FIG. 2 (*a*), when the twist-loop 20 travels up and reaches the entwined portion 1, as shown in FIG. 2 (*b*), it is unravelled gradually by the thread 19 rubbing against itself.

Figure 3A:
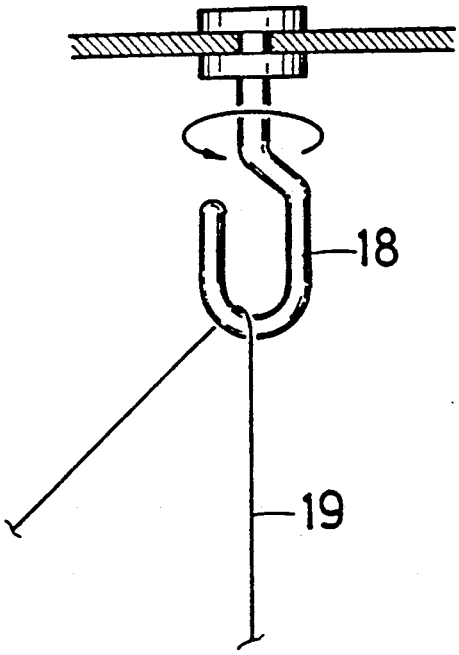
Figure 3B:
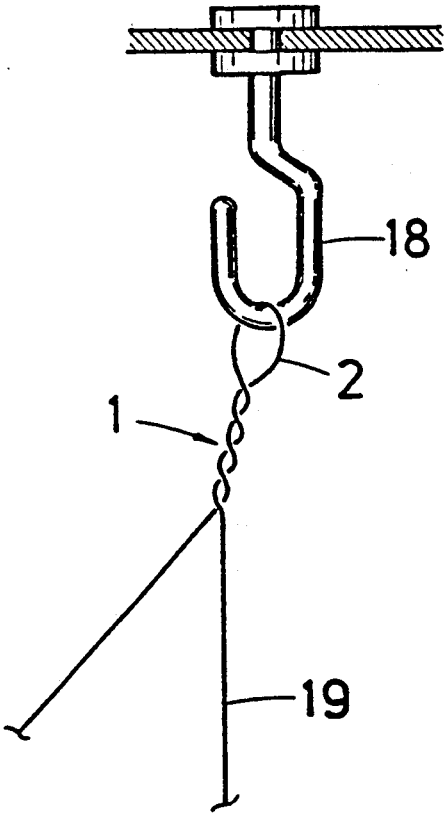

The vertical-twist-loop 2 shown in the embodiment is produced by catching the thread 19 with a finger and hanging the thread on the fixed hook 18 after twisting it three times. to form a vertical-twist-loop 2, however, as shown in FIG. 3 (*a*), after simply hanging the thread 19 on a rotatably supported rotary hook 21, the rotary hook 21 is rotated as shown in FIG. 3 (*b*).

Figure 4A:
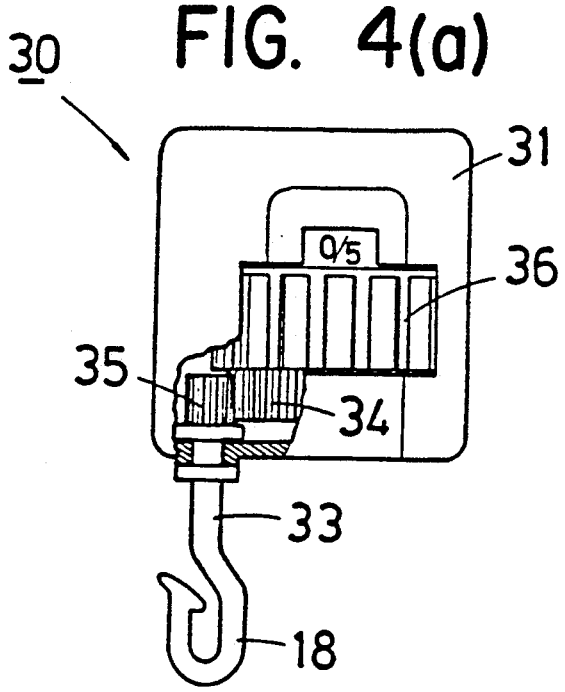
Figure 4B:
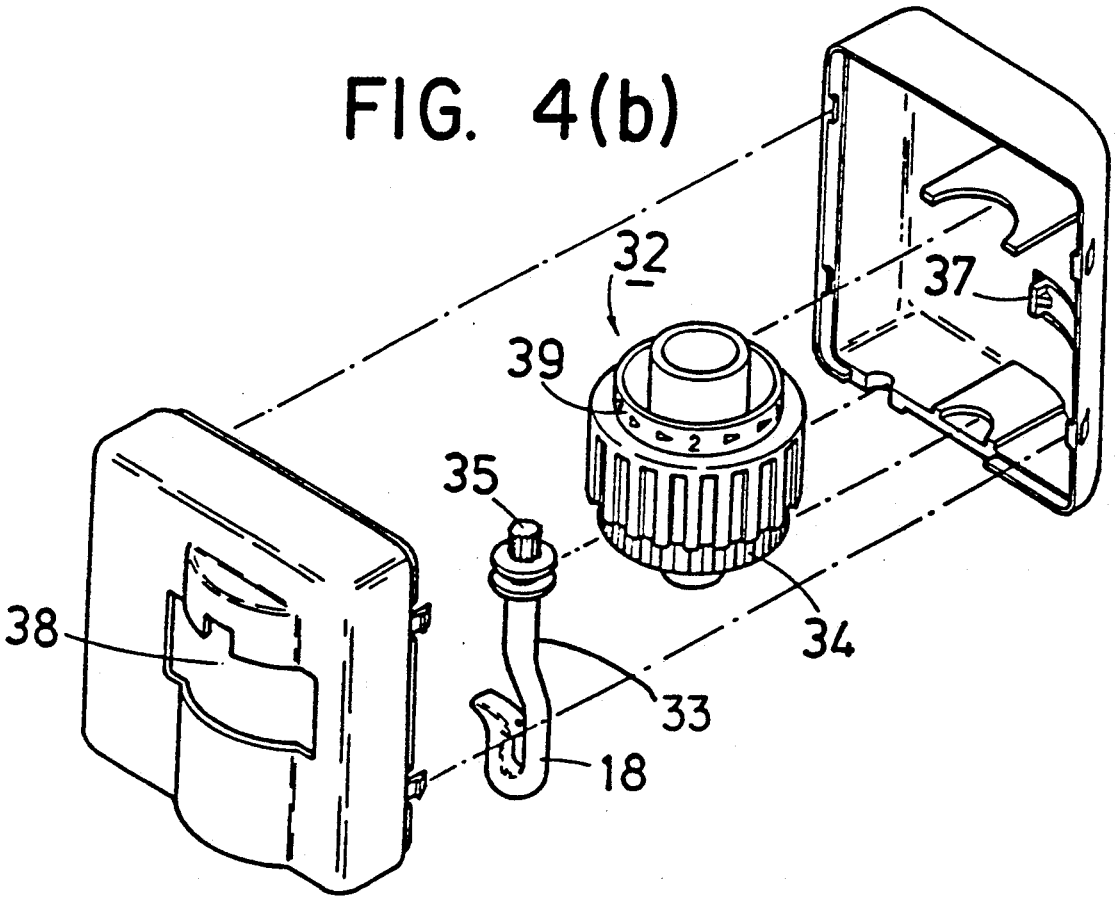

FIGS. 4 (*a*), (*b*) show an embodiment of a hanger 30 for supplying a thread in accordance with the present invention, wherein a dial 32 is supported rotatably within a case body 31, and a shaft 33, formed with a hook 18 at the lower end thereof, is supported rotatably at the bottom of the case body 31. The dial 32 is partly exposed through a window 38 provided on a surface of the case body 31 so that it can be rotated with a finger. At the lower end of the dial 32, a gear 34 is formed to mesh with a gear 35 formed at the upper end of the shaft 33. On the periphery of the dial 32, there are formed alternating projections and depressions 36, extending axially, to serve as a stopper when the dial 32 is rotated, and to permit rotation in one direction by engaging with a claw 37 formed inside the rear side of the case body 31, as shown in FIG. 4 (*b*). Moreover, around the upper end of the dial 32, a scale 39 is provided to indicate the number of rotations of the hook 18 caused by rotation of the dial 32. In a present embodiment, the gear ratio is set such that when the dial 32 makes one rotation, the hook 18 is rotated five times.

The hanger 30 is fixed above the reel 10 and the thread is caught by the hook 18 projecting from the bottom of the case body 31. The thread 19 may either be hung on the hook 18 and then set on the sewing machine 11, or hung on the hook 18 between the reel 10 and the sewing machine 11, after being set directly on the sewing machine. After the thread 19 is caught by the hook 18, the hook is rotated about three times by rotating the dial 32 with a finger to form a vertical-twist-loop 2. The thread 19 is now ready to be supplied to the sewing machine 11.

Figure 5:
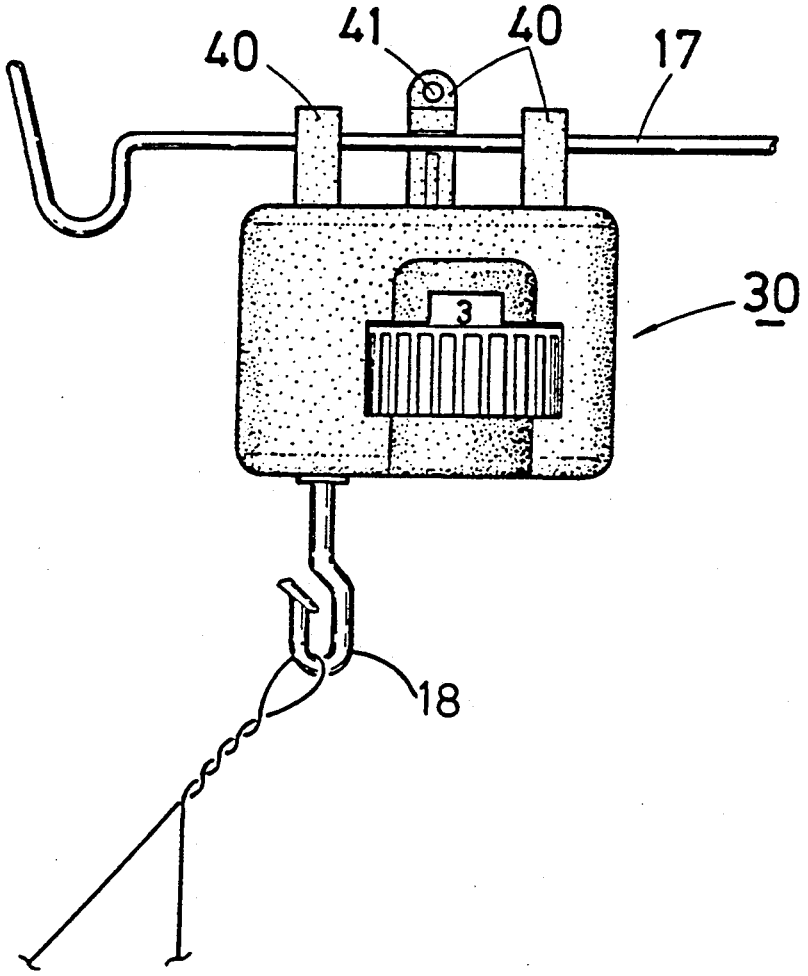
FIG. 5 is a front view showing another embodiment of a hanger.

To attach the hanger 30, as shown in FIG. 5, lock members 40 provided on the upper surface of the case body 31 are preferably caught by a horizontal arm 17 of a thread stand 13.

Also, in the present embodiment, a hole 41 is opened through the lock member 40 on the rear side, and when the horizontal arm 17 is a plate or the hanger 30 is mounted on a wall surface or the like, a fastener is inserted through the hole 41 to be fixed to the plate, wall or the like.

Figure 6:
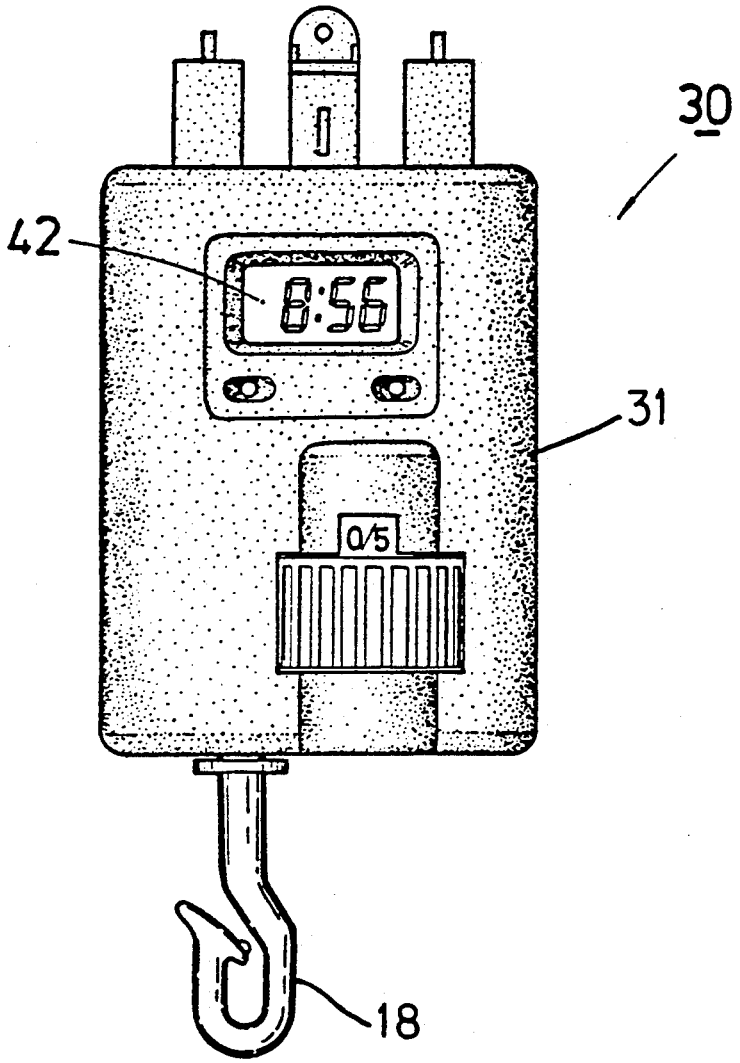
FIG. 6 is a front view showing still another embodiment of a hanger.
Figure 7:
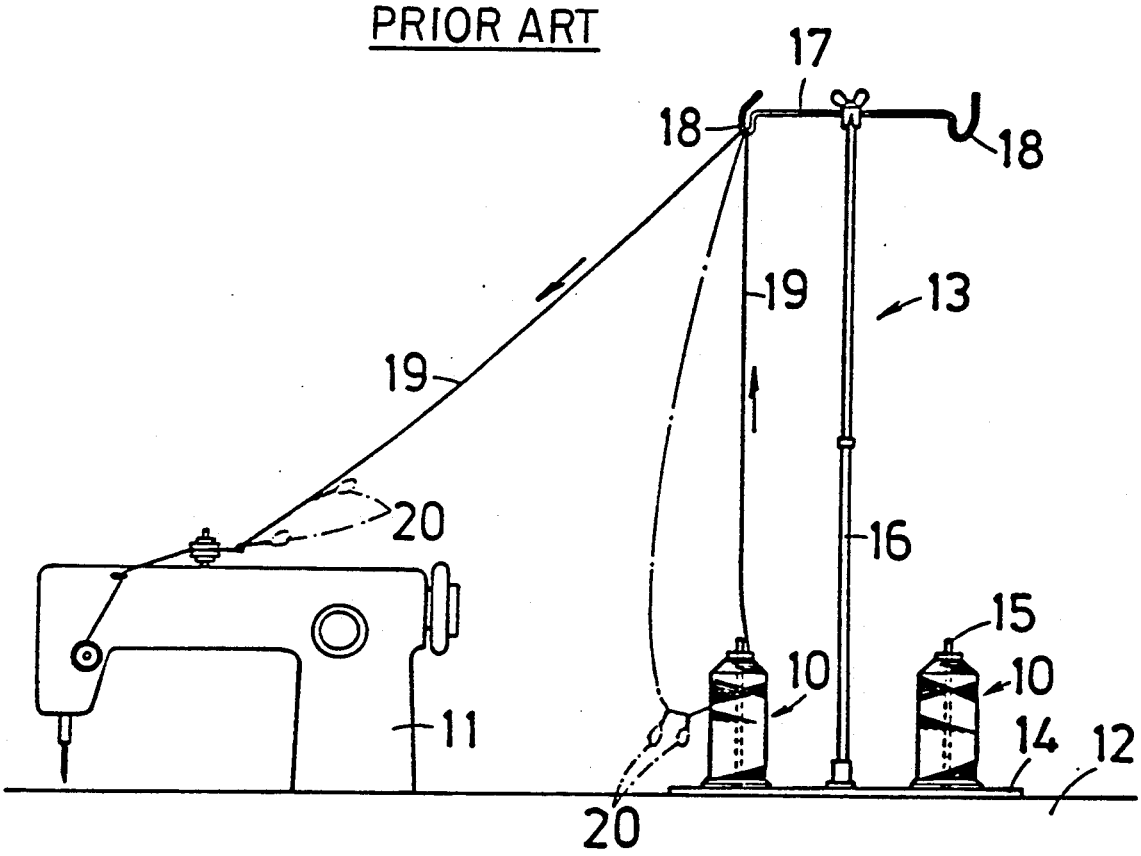
FIG. 7 PRIOR ART
FIG. 7 is a front view showing a prior art embodiment wherein a thread is supplied to a sewing machine, and FIG. 8 (*a*) to (*d*) are schematic views respectively showing twisted, loop-twisted and vertical-twisted states of a thread.
Figure 8A:
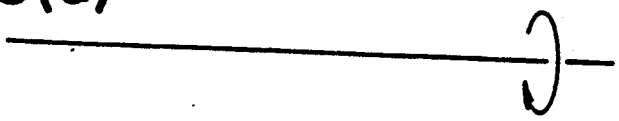
Figure 8B:
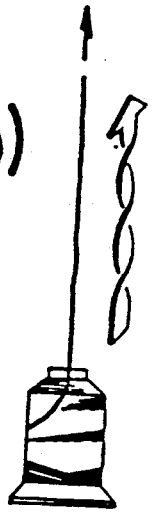
Figure 8C:
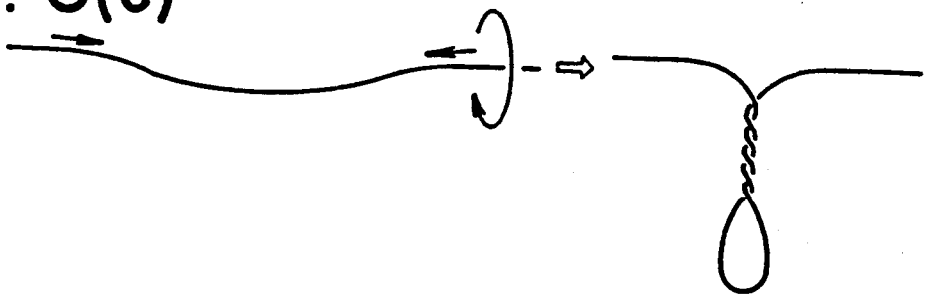
Figure 8D:
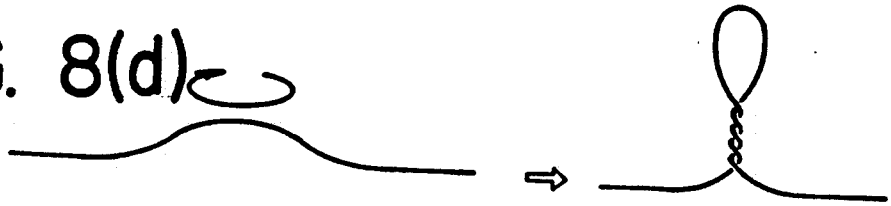

FIG. 6 shows another embodiment of a hanger 30, wherein a digital clock 42 is incorporated in the case body 31. Since the hanger 30 is usually located in front of the operator, the clock 42 provided thereon is very easy to see. As a result, it is advantageous in that a consciousness of time management of the operator is improved to thereby increase efficiency.

By employing a method of supplying a thread to a sewing machine, and a hanger used therein according to the present invention, the following various advantages are anticipated.

(1) Unwanted twist-loops that are produced can be surely eliminated.

(2) Since the unwanted twist-loops that are produced are prevented from reaching the sewing machine, such troubles as breaking a thread and an uneven seam can be prevented. An increase of productivity results.

(3) When operation of the sewing machine is stopped, though the thread between the reel and the sewing machine tends to become slack, since a friction force is exerted on the lower entwined portion of the loop when holding the loop by the hanger, tension is maintained between the reel and the sewing machine to completely prevent the twist-loop from occurring.

(4) When a hanger of the present invention is used, a vertical-twist-loop can be formed and maintained very easily merely by rotating a dial.

What is claimed:

1. A method of supplying thread to a sewing machine, said thread being wound around the axis of a reel, comprising the steps:

drawing said thread from said reel in the generally axial direction thereof;

suspending said thread above said reel on a hanger, by passing said hanger through a loop formed in said thread, said loop having a beginning and an ending a first portion of said thread preceding the beginning of said loop and a second portion of said thread following the ending of said loop being entwined, one said portion with the other said portion.

2. A method as in claim 3, wherein said loop and said entwined portions are produced by one of loop twisting and vertical twisting.

3. A method as in claim 3, wherein said loop is formed by twisting said thread before said thread is suspended on said hanger.

4. A method as in claim 3, wherein said loop is formed after said thread is suspended from said hangar, and further comprising the step of twisting said drawn, suspended thread by turning said hanger to form said loop.

5. A method as in claim 1, wherein said loop is opened so as to receive said hanger therethrough.

6. A hanger for supporting a thread being supplied to a sewing machine from a reel having a reel axis wherearound said thread is wound, comprising:

a case body;

a shaft projecting from said body and rotatably mounted to said body, one end of said shaft being formed as a hook to catch said thread;

a dial rotatably mounted to said case body for rotation about a body axis;

coupling means connecting said dial to said shaft for rotating said hook when said dial is rotated.

7. A hanger as in claim 6, wherein said coupling means includes gearing.

8. A hanger as in claim 6, wherein said dial is within said case body, said dial being at least in part exposed through an opening in said case body.

9. A hanger as in claim 6, wherein said dial is generally cylindrical and includes position markers on a circumferential surface thereof.

10. A hanger as in claim 6, further comprising holding means engaging said body and said dial for maintaining the rotative position of said dial when no force is applied thereto.

11. A hanger as in claim 10, wherein said holding means includes a ratchet-type engagement means for permitting rotation of said dial in only one direction.

12. A hanger as in claim 6, wherein said hook shaft rotates about an axis parallel to said body axis of said dial.

* * * * *